US010781582B2

(12) United States Patent
Tazarv et al.

(10) Patent No.: US 10,781,582 B2
(45) Date of Patent: Sep. 22, 2020

(54) APPARATUS, SYSTEMS AND METHODS FOR REPAIRABLE PRECAST MOMENT-RESISTING BUILDINGS

(71) Applicant: South Dakota Board of Regents, Pierre, SD (US)

(72) Inventors: Mostafa Tazarv, Brookings, SD (US); Abdullah Boudaqa, Sioux Falls, SD (US)

(73) Assignee: South Dakota Board of Regents, Pierre, SD (US)

( * ) Notice: Subject to any disclaimer, the term of this patent is extended or adjusted under 35 U.S.C. 154(b) by 0 days.

(21) Appl. No.: 16/131,863

(22) Filed: Sep. 14, 2018

(65) Prior Publication Data

US 2019/0078315 A1 Mar. 14, 2019

Related U.S. Application Data

(60) Provisional application No. 62/558,708, filed on Sep. 14, 2017.

(51) Int. Cl.

| | |
|---|---|
| ***E04B 1/21*** | (2006.01) |
| ***E04H 9/02*** | (2006.01) |
| ***E04B 5/04*** | (2006.01) |

(52) U.S. Cl.

CPC ..... *E04B 1/215* (2013.01); *E04H 9/02* (2013.01); *E04B 5/04* (2013.01)

(58) Field of Classification Search

CPC ... E04B 1/215; E04B 5/04; E04B 1/18; E04H 9/02; E04H 9/024

See application file for complete search history.

(56) References Cited

U.S. PATENT DOCUMENTS

| | | | | |
|---|---|---|---|---|
| 2,569,669 | A * | 10/1951 | Henderson | E04B 1/21 52/283 |
| 7,171,787 | B2 * | 2/2007 | Thomason | E04H 4/0087 52/169.7 |
| 9,157,251 | B2 | 10/2015 | Newman et al. | |
| 9,534,411 | B2 | 1/2017 | Kurosawa | |

(Continued)

FOREIGN PATENT DOCUMENTS

| | | |
|---|---|---|
| CN | 204040209 | 12/2014 |
| GB | 626097 | 7/1949 |

OTHER PUBLICATIONS

Boudaqa, "Repairable Precast Buildings and Bridges", "Electronic Thesis and Dissertations", Jan. 1, 2018, Publisher: https://openprairie.sdstate.edue/etd/2467.

(Continued)

*Primary Examiner* — Basil S Katcheves
*Assistant Examiner* — Omar F Hijaz
(74) *Attorney, Agent, or Firm* — Davis, Brown, Koehn, Shors & Roberts, P.C.; Matthew Warner-Blankenship

(57) ABSTRACT

The disclosed apparatus, systems and methods relate to reinforced concrete moment-resisting buildings with precast beams, precast columns, and replaceable buckling restrained reinforcements. Modular channels and pins or boxes are provided that allow for the replacement and repair of the precast moment-resisting beams and columns. Replaceable buckling restrained reinforcements are used to attach the beams and columns via embedded reinforcements and couplers.

18 Claims, 11 Drawing Sheets

(56) References Cited

U.S. PATENT DOCUMENTS

| | | | | |
|---|---|---|---|---|
| 9,677,274 | B2 | 6/2017 | Saiidi | |
| 10,465,374 | B2 * | 11/2019 | Sugaya | E04B 1/5837 |
| 2008/0282623 | A1 | 11/2008 | Powell | |
| 2011/0308198 | A1 * | 12/2011 | Comerford | E04C 5/165 52/848 |
| 2016/0090728 | A1 * | 3/2016 | Miller | E04B 1/215 52/637 |
| 2017/0175376 | A1 | 6/2017 | Calderon Uriszar-Aldaca et al. | |
| 2017/0356177 | A1 * | 12/2017 | Lee | E04B 1/58 |

OTHER PUBLICATIONS

Brinson, L.C., "One-Dimensional Constitutive Behavior of Shape Memory Alloys: Thermomechanical Derivation with Non-Constant Material Functions and Redefined Martensite Internal Variable", "Journal of Intelligent Material Systems and Structures", 1993, pp. 229-242, vol. 4.

Burton, et al., "Finite Element Simulation of a Self-Healing Shape Memory Alloy Composite", "Mechanics of Materials", 2006, pp. 525-537, vol. 38, No. 1.

Cattanach et al., "1st Century Precast: The Detailing and Manufacture of NZ's First Multi-Storey PRESSS-Building", "NZ Concrete Industry Conference.", 2008, Published in: Rotorua.

Cho et al., "Structural Morphing Using Two-Way Shape Memory Effect of SMA", "International Journal of Solids and Structures", 2005, p. 1759, vol. 42, No. 1.

Conley et al., "Precast Seismic Structural Systems PRESSS-3: The Five-Story Precast Test Building vol:3.5: Wall Direction Response", "Structural System Research Project,", 2002, vol. SSRP Report No. 99-1, Published in: University of California, San Diego, CA.

Desroches et al., "Cyclic Properties of Superelastic Shape Memory Alloy Wires and Bars", "Journal of Structural Engineering", 2004, pp. 38-46, vol. 130, No. 1.

Desroches at al., "Shape Memory Alloys in Seismic Resistant Design and Retrofit: A Critical Review of Their Potential and Limitations", "Journal of Earthquake Engineering", 2004, pp. 415-429, vol. 8, No. 3.

Dolce et al., "Theoretical and Experimental Studies for the Application of Shape Memory Alloys in Civil Engineenng", "Journal of Engineering Materials and Technology", , pp. 302-311, vol. 128, No. 1.

Dongzhi et al., "Xperimental Study of a New Beam-to-Column Connection for Precast Concrete Frames Under Reversal Cyclic Loading", "Advances in Structural Engineering Journal", 2016, pp. 529-545, vol. 19, No. 3.

Ehsani et al., "Exterior Reinforced Concrete Beam-to-Column Connections Subjected to Earthquake-Type Loading", "Paper presented at the Journal Proceedings.", 1985.

Ehsani et al., "Comparison of Inelastic Behavior of Reinforced Ordinary- and High-Strength Concrete Frames", "Structural Journal", 1987, pp. 161-169, vol. 84, No. 2.

Guerrini et al., "Self-Centering Precast Concrete Dual-Steel-Shell Columns for Accelerated Bridge Construction: Seismic Performance, Analysis, and Design", "PEER Report No. 2015/13", 2015, Publisher: Pacific Earthquake Engineering Research Center, Published in: University of California, Berkeley.

Guerrini et al., "Seismic Behavior of Posttensioned Self-Centering Precast Concrete Dual-Shell Steel Columns,", "Journal of structural engineering", 2014, vol. 141, No. 4.

Guo et al., "Cyclic Load Tests on Self-Centering Concrete Pier with External Dissipaters and Enhanced Durability", "Journal of structural engineering", 2015, vol. 142, No. 1.

Joh et al., "Influence of Transverse Joint and Beam Reinforcement and Relocation of Plastic Hinge Region on Beam Column Joint Stiffness Deterioration", "Special Publication", 1991, pp. 187-224, vol. 123.

Li et al., "Experimental and Numerical Investigations on the Seismic Behavior of Lightly Reinforced Concrete Beam-Column Joints", "Journal of structural engineering", 2009, pp. 1007-1018, vol. 135, No. 9.

Lukkunaprasit et al., "Enhancement of Seismic Performance of Reinforced Concrete Columns with Buckling-Restrained Reinforcement", "Engineering Structures", 2011, pp. 3311-3316, vol. 33.

Marriott et al., "Biaxial Testing of Unbonded PostTensioned Rocking Bridge Piers with External Replaceable Dissipaters", "Earthquake Engineering & Structural Dynamics", 2011, pp. 1723-1741, vol. 40, No. 15.

Marriott et al., "QuasiStatic and PseudoDynamic Testing of Unbonded Post-Tensioned Rocking Bridge Piers with External Replaceable Dissipaters", "Earthquake Engineering & Structural Dynamics", 2009, pp. 331-354, vol. 38, No. 3.

Mashal et al., "Quasi-Static Cyclic Tests of Half-Scale Fully Precast Bridge Bents Incorporating Emulative and Posttensioned Low Damage Solutions", "2nd European Conf. of Earthquake Engineering and Seismolog", 2014, Publisher: Turkish Earthquake Foundation, Published in: Istanbul, Turkey.

Mesa et al., "Developments of Advanced Solutions for Seismic Resisting Precast Concrete Frames", "Developments of Advanced Solutions for Seismic Resisting Precast Concrete Frames", 2010, Publisher: University of Canterbury, Published in: Christchurch, New Zealand.

Palermo et al., "Enhanced Seismic Performance of Hybrid Bridge Systems: Comparison with Traditional Monolithic Solutions", "Journal of Earthquake Engineering", 2008, pp. 1267-1295, vol. 12, No. 8.

Pampanin, "Emerging Solutions for High Seismic Performance of Precast/Prestressed Concrete Buildings", "Journal of Advanced Concrete Technology", 2005, pp. 207-223, vol. 3, No. 2.

Sarti et al., "Fuse-Type External Replaceable Dissipaters: Experimental Program and Numerical Modeling", "Journal of structural engineering", 2016.

Scott, Richard H., "Intrinsic Mechanisms in Reinforced Concrete Beam-Column Connection Behavior", "ACI Structural Journal", 1996, pp. 336-346, vol. 93, No. 3.

Stone et al., "Performance of Hybrid Moment-Resisting Precast Beam-Column Concrete Connections Subjected to Cyclic Loading", "ACI Structural Journal", 1995, pp. 1205-1222, vol. 12, No. 7.

Tazarv et al., "Design and Construction of Bridge Columns Incorporating Mechanical Bar Splices in Plastic Hinge Zones", "Department of Civil and Environmental Engineering", 2015, Publisher: Center for Civil Engineering Earthquake Research, Published in: University of Nevada, Reno, Nevada.

Tazarv, Mostafa, "Next Generation of Bridge Columns for Accelerated Bridge Construction in High Seismic Zones", "CCEER Report No. 14-06", , Publisher: Center for Civil Engineering Earthquake Research, Published in: University of Nevada, Reno, NV.

Tazarv et al., "Seismic Design of Bridge Columns Incorporating Mechanical Bar Splices in Plastic Hinge Regions", "Engineering Structures", 2016, pp. 507-520, vol. 124.

Tsonos, "Cyclic Load Behavior of Reinforced Concrete Beam-Column Subassemblages of Modern Structures", "ACI Structural Journal,", 2007, p. 468, vol. 104, No. 4.

Tsonos, "Lateral load response of strengthened reinforced concrete beam-to-column joints,", "ACI Structural Journal", 1999, pp. 46-56, vol. 96.

Tuhin, Ishtiaque Ahmed, "Application of New Materials and Innovative Detailing for Reinforced Concrete Structures", "MSc Thesis", 2016, Publisher: South Dakota State University, Published in: Brookings, SD.

White et al., "Quasi-Static Testing of Posttensioned Nonemulative Column-Footing Connections for Bridge Piers", "Journal of Bridge Engineering,", 2016, vol. 21, No. 6.

Youssef et al., "Experimental Investigation on the Seismic Behavior of Beam-Column Joints Reinforced with Superelastic Shape Memory Alloys", "Journal of Earthquake Engineering", 2008, pp. 1205-1222, vol. 12, No. 7.

(56) References Cited

OTHER PUBLICATIONS

Zaghi et al., "Seismic Design of Pipe Pin Connections in Concrete Bridges", "Center for Civil Engineering Earthquake Research", 2010, Publisher: University of Nevada, Published in: Reno, Nevada.
Zhou, Hua, "Reconsideration of Seismic Performance and Design of Beam-Column Joints of Earthquake-Resistant Reinforced Concrete Frames", "Journal of structural engineering", , pp. 762-773, vol. 135, No. 7.

* cited by examiner

APPARATUS, SYSTEMS AND METHODS FOR REPAIRABLE PRECAST MOMENT-RESISTING BUILDINGS

CROSS-REFERENCE TO RELATED APPLICATION(S)

This application claims priority to U.S. Provisional Application No. 62/558,708 filed Sep. 14, 2017 and entitled "Apparatus, Systems and Methods for Repairable Precast Moment-Resisting Buildings," which is hereby incorporated by reference in its entirety under 35 U.S.C. § 119(e).

TECHNICAL FIELD

The disclosed technology relates generally to devices, systems and methods allowing for the accelerated construction of reinforced concrete (RC) moment-resisting (MR) buildings with precast beams, precast columns, and replaceable buckling restrained reinforcement (BRR).

BACKGROUND

Although modern design specifications ensure collapse prevention for buildings and bridges under severe earthquakes, the damage of structural components is expected. Minor damage may be repaired but excessive damage results in total replacement of the structure. Either case imposes substantial economic and social costs to owners, residents, and public. For example, the 1994 Northridge earthquake in California caused more than $20 billion damage to buildings and bridges.

Even though life safety is guaranteed in modern building design codes, damage of structural components is expected under severe earthquakes. Significant yielding of reinforcement or core concrete failure in a few structural components may lead to total replacement of an RC building. Current practice does not guarantee low-cost or successful repair for most types of buildings after a strong earthquake. For example, after the 2011 Christchurch earthquake, approximately 100,000 homes required demolition, 100,000 other homes were severely damaged, 45% of buildings in the central city had restricted access, and $40 billion was needed to rebuild the affected structures (UC Quick Center, 2017). Approximately 19% of RC buildings in the central business district were rated unsafe with a red tag after this earthquake. Cast-in-place (CIP) construction of MR RC buildings is relatively slow, CIP structural components are difficult to repair after a severe event, and CIP does not offer component disassembly for repair or replacement. Precast MR RC buildings with disassembly scheme are fast to construct and easy to repair resulting in minimal economic and social impacts after severe events benefiting the owner, the public, and governments.

Structural engineers usually replace a building often worth millions of dollars when a few structural components fail, the repair of the damaged components is impractical, or the total repair cost is more than 50% of the replacement cost. The instant disclosure relates to a new connection for moment-resisting reinforced concrete buildings which will simultaneously accelerate construction and will allow component disassembly for replacement as a quick and cost-effective repair technique.

BRIEF SUMMARY

Discussed herein are various devices, systems and methods incorporating precast beams and columns, detachable buckling restrained reinforcement (BRR), and mechanical bar splices to accelerate construction of reinforced concrete (RC) moment-resisting (MR) buildings and to reduce post-event damage and repair need. Precast beams with embedded steel channels (made of channels or angles) at their ends laterally slide into precast columns, which have embedded steel boxes at the floor levels. The interaction between the steel channel and the steel box provides shear transfer. Replaceable BRRs connect the beam reinforcement to the column reinforcement through detachable mechanical bar splices and provide moment-resisting connections.

The disclosed implementations offer a simple detailing for moment-resisting reinforced concrete buildings to combine the benefit of precast construction with low-cost repair. The repair strategy, replacement of broken components, is applicable not only to very important structures (e.g. hospitals, fire departments) but also for those belong to mainstream owners (e.g. single-family houses). Total building replacement will not be a concern using the detailing.

In Example 1, a moment-resisting precast beam-column joint comprising at least one precast beam comprising at least one neck and at least one longitudinal reinforcement bar disposed therein; at least one precast column; at least one modular pin; at least one modular channel; and a plurality of replaceable buckling restrained reinforcement and couplers disposed about the neck and joined to the at least one longitudinal reinforcement bar wherein the at least one pin is configured to couple to the at least one channel so as to join the at least one beam to the at least one column.

In Example 2, the moment-resisting precast beam-column joint of Example 1, wherein at least one opening is defined in the at least one beam and the at least one pin is inserted into the at least one column within the at least one opening.

In Example 3, the moment-resisting precast beam-column joint of Example 1, wherein at least one opening is defined in the at least one column to support the at least one modular column, and the at least one pin is housed in the at least one beam.

In Example 4, the moment-resisting precast beam-column joint of Example 1, further comprising at least one neck longitudinal reinforcement.

In Example 5, the moment-resisting precast beam-column joint of Example 1, further comprising at least one body longitudinal reinforcement.

In Example 6, the moment-resisting precast beam-column joint of Example 1, wherein the at least one neck has a length ($L_{neck}$) and each of the plurality of replaceable buckling restrained reinforcements have a BRR fuse length ($L_{fuse}$), and $L_{neck}$ is not less than $L_{fuse}$ plus four times the length of the couplers ($L_{sp}$).

In Example 7, the moment-resisting precast beam-column joint of Example 6, wherein the neck depth ($d_{neck}$) is not be less than the depth of the beam ($d_{beam}$) less three times the coupler 22 diameter ($D_{sp}$).

In Example 8, the moment-resisting precast beam-column joint of Example 6, wherein the beam has a body having a depth ($d_{beam}$) and $L_{fuse}$ is not less than about 0.25 $d_{beam}$.

In Example 9, the moment-resisting precast beam-column joint of Example 8, wherein $L_{fuse}$ does not exceed about 0.75 $d_{beam}$.

In Example 10, a moment-resisting precast beam-column joint comprising: a precast beam comprising: a body comprising at least one longitudinal reinforcement bar disposed therein; an elongate opening disposed therethrough; first and second necks disposed at either end of the body; and first and second modular channels disposed in the elongate opening within the first and second necks, respectively; a precast column comprising at least one column bar, the precast column housing a modular pin; and a plurality of replaceable buckling restrained reinforcements and couplers disposed about the first and second neck and joined to the at least one longitudinal reinforcement bar, wherein: the modular pin is configured to couple to the modular channel, and the plurality of buckling restrained reinforcements and couplers are configured to join the at least one longitudinal reinforcement bar and at least one column bar so as to join the beam to the column.

In Example 11, the moment-resisting precast beam-column joint of Example 10, wherein the modular pin and first and second modular channels are constructed and arranged so as to be replaceable.

In Example 12, the moment-resisting precast beam-column joint of Example 10, wherein the plurality of buckling restrained reinforcements are dog bone buckling restrained reinforcements.

In Example 13, the moment-resisting precast beam-column joint of Example 10, wherein the plurality of buckling restrained reinforcements comprise: a confining steel tube; filling materials; and a steel bar.

In Example 14, the moment-resisting precast beam-column joint of Example 13, wherein the steel bar is a deformed steel bar.

In Example 15, a moment-resisting precast beam-column joint system, comprising a precast beam comprising a body comprising at least one longitudinal reinforcement bar disposed therein; and first and second necks disposed at either end of the body; a precast column comprising at least one column bar; at least one modular channel; a modular shear pin constructed and arranged to couple to the modular channel; and a plurality of replaceable buckling restrained reinforcements and couplers disposed about the first and second neck and joined to the at least one longitudinal reinforcement bar and at least one column bar.

In Example 16, the moment-resisting precast beam-column joint system of Example 15, wherein the plurality of buckling restrained reinforcements and couplers are configured to join the at least one longitudinal reinforcement bar and at least one column bar so as to join the beam to the column.

In Example 17, the moment-resisting precast beam-column joint system of Example 15, wherein the at least one modular channel is housed in the precast beam.

In Example 18, the moment-resisting precast beam-column joint system of Example 15, wherein the plurality of buckling restrained reinforcements comprise a confining tube; grout; and a steel bar disposed therethrough.

In Example 19, the moment-resisting precast beam-column joint system of Example 15, wherein the longitudinal reinforcement bar is debonded.

In Example 20, the moment-resisting precast beam-column joint system of Example 15, wherein the at least one column bar is disposed around the column opening.

While multiple embodiments are disclosed, still other embodiments of the disclosure will become apparent to those skilled in the art from the following detailed description, which shows and describes illustrative embodiments of the disclosed apparatus, systems and methods. As will be realized, the disclosed apparatus, systems and methods are capable of modifications in various obvious aspects, all without departing from the spirit and scope of the disclosure. Accordingly, the drawings and detailed description are to be regarded as illustrative in nature and not restrictive.

DETAILED DESCRIPTION

The various embodiments disclosed or contemplated herein relate to precast beams and columns, detachable buckling restrained reinforcement, and mechanical bar splices to accelerate construction of reinforced concrete moment-resisting buildings and to reduce post-event damage and repair need.

Figure 1A:
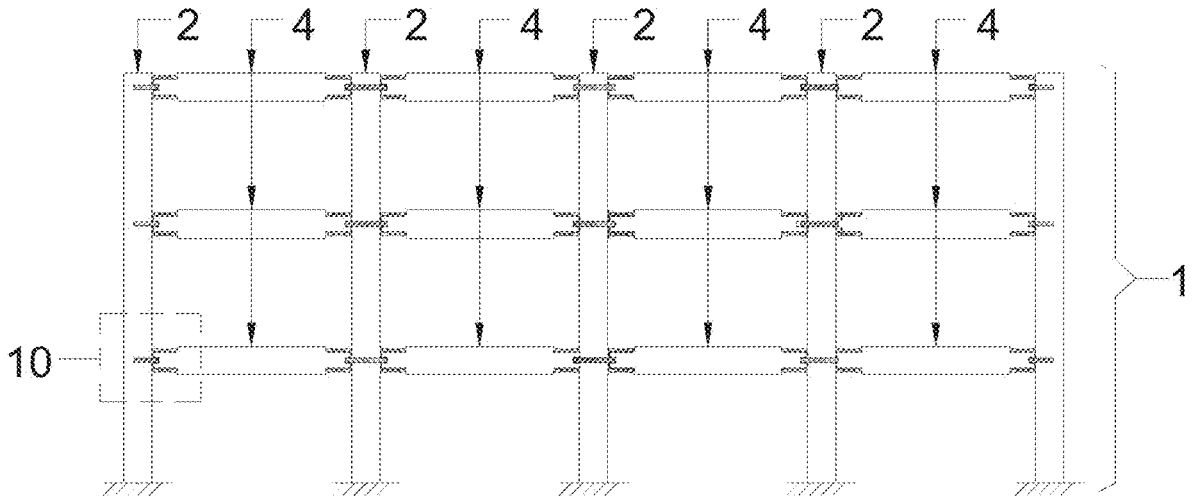
FIG. 1A is a schematic representation of a structure built using a repairable precast moment-resisting beam-column joint, according to certain implementations.

Turning to the drawings in greater detail, FIG. 1A illustrates a precast frame 1 including precast columns 2, precast beams 4. In various implementations, these precast beams 4 are connected to precast columns 4 using precast beam-column (PBC) joints 10. Other configurations and element orientations would be understood by those of skill in the art.

Figure 1B:
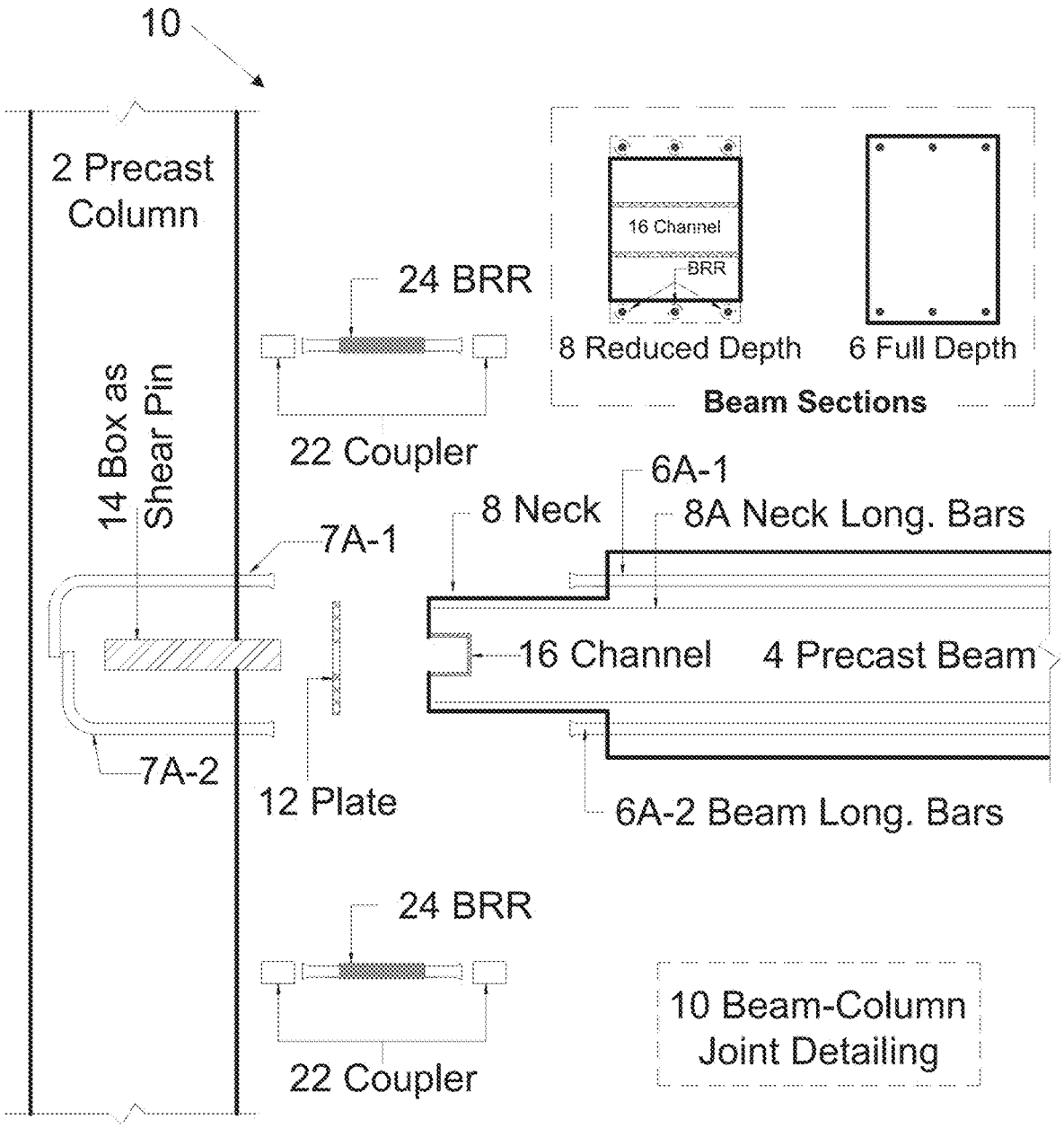
FIG. 1B is a detailed exploded schematic representation of a structure built using a repairable precast moment-resisting beam-column joint, according to one implementation.

FIG. 1B illustrates a PCB joint 10 shown in FIG. 1A, where a precast beam 4 is connected to a precast column 2, according to certain detailing. It is understood that fully precast columns 2 and beams 4 are typically fabricated offsite in a controlled environment for improved quality, for assembly into the structure on-site.

As shown in FIG. 1B, the precast beam 4 consists of a reduced, or neck section 8 at each precast beam end, and a full depth section elsewhere.

In various implementations, the exterior precast beam longitudinal bars 6A can be debonded from the concrete for a length of approximately six times the diameter of the bar from the intersection of the body 6 and the neck 8. It is understood that debonding of the beam longitudinal bars 6A can be done by wrapping the bars with two layers of duct tape. Other approaches include encasing the bar with a PVC pipe.

In various implementations, the neck 8 is longitudinally reinforced with bars 8A extended to the beam 4. In various implementations, these neck longitudinal reinforcement 8A shall be sufficient to resist approximately 1.25 times the plastic moment of the original beam section 6. In these and other implementations, the neck longitudinal reinforcement 8A is placed or otherwise oriented inside the beam 4 compliant with current code development length requirements. That is, the neck 8 should remain capacity protected with minimal damage.

In various implementations, one or more plates 12 such as steel plates 12 can be placed at the either end of the beam 4. These plates are constructed and arranged to surround boxes or pins 14. In one non-limiting, illustrative implementation, steel plates 12 with a minimum thickness of approximately 0.5 inches are placed at any joint 10 to prevent concrete damage during lateral deformations. It is understood that steel plates 12 provide more uniform stress distribution at the beam-column interface joint 10 and will minimize the concrete damage. It is further understood that a wide array of sizes and shapes of plates 12 are contemplated.

In various implementations, the plastic shear loads are transferred between the precast beams 4 and the precast columns 2 via the PCB joint 10 as shown in FIG. 1B. In some implementations, one or more modular shear boxes or pins 14 mate with modular channels 16 (as shown in FIG. 1B) or the openings 17 defined in the beam (sometimes also called a "channel" that is an opening running from end-to-end within the beam) or sockets 17 (as shown FIG. 1C). It is therefore understood that as described herein, the sockets 17 relate to openings 17 defined in either the column 2 or beam 4 used to support or enclose the modular channels 16. Likewise, the pins 14 are housed within lumens defined in openings in the co-joining piece so as to mate with the modular channel 16 or socket.

That is, in various implementations, modular steel channels 16 can be embedded in the channel opening 17 in the distal end of the beam 2 in the neck 8 or within the side of the column 2 in a socket 17, so as to be coupled with a corresponding pin 14 disposed in the adjoining member in a male/female, tongue-and-groove configuration, as would be understood by those of skill in the art.

It is further appreciated that in various implementations, the modular channel 16 is optional, and the pin 14 can be disposed directly into a channel opening 17 or socket 17, though this implementation is structurally viable.

Further, it is readily appreciated that these components—the pin 14 and/or channel 16—are modular, meaning that they can allow removal and replacement of beam and column in the event of damage.

Figure 1C:
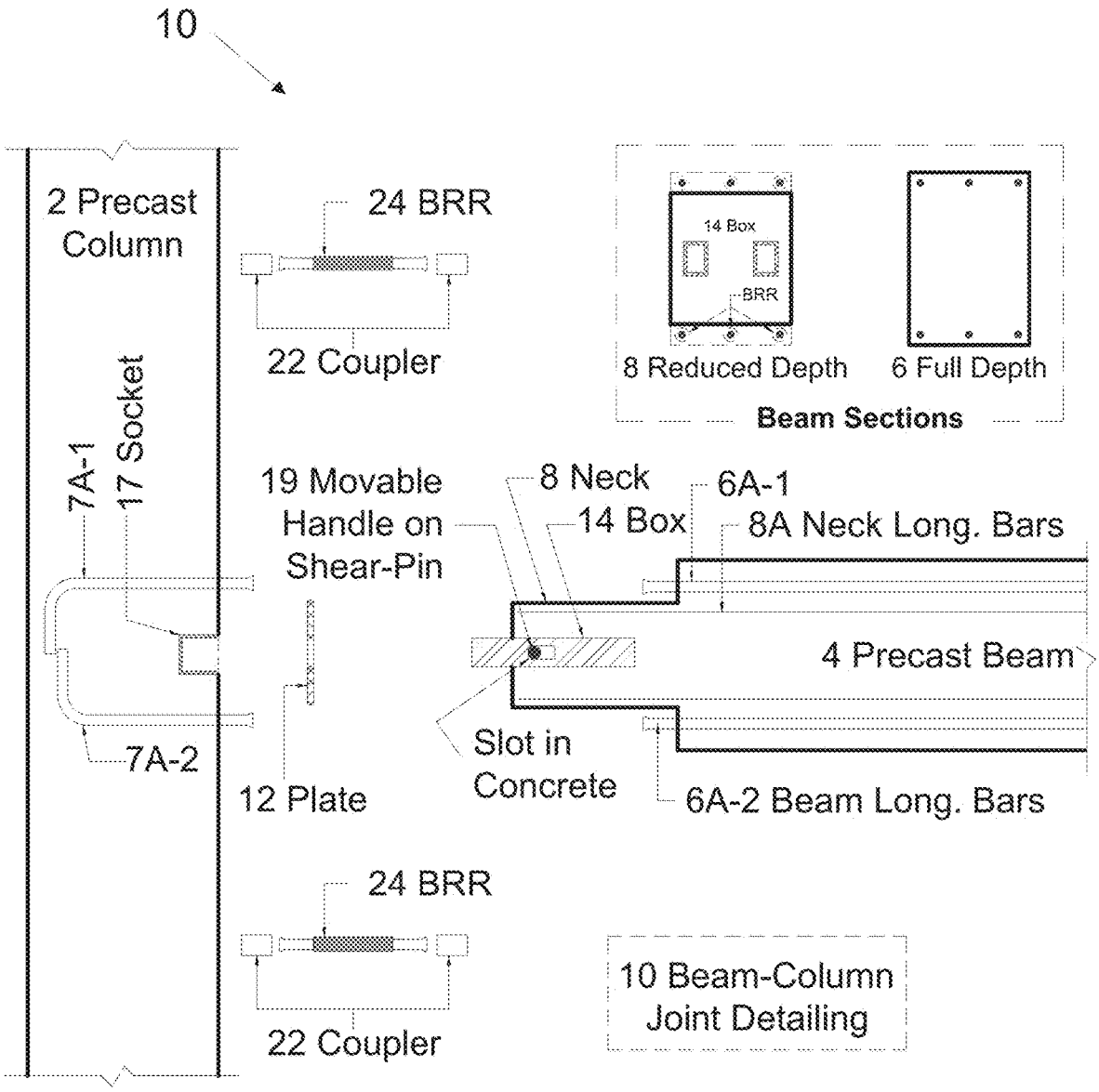
FIG. 1C is a detailed exploded schematic representation of a structure built using a repairable precast moment-resisting beam-column joint, according to another implementation.

Accordingly, in alternative implementations, like that of FIG. 1C, male steel pins 14 are embedded in the beams 4 to be inserted into columns 2 having female modular channels 16/sockets 17. In certain implementations, the pins 14 can be moveable (that is, move in the axial direction of the beam) for the ease of construction, for example via handles 19 on one or more sides of the pin. Those of skill in the art would readily appreciate the advantages of either configuration.

Importantly, in each of these implementations, the connection between the modular pin 14 and the modular channel 16 (or the pin 14 and the socket 17) provides shear resistance at the PCB joint 10. While steel is discussed in the implementation of FIG. 1B and FIG. 1C, it is understood that both the modular channel 16, the socket 17, and/or the modular box or pin 14 can be comprised of other materials such as high-strength alloys and the like, as would be appreciated by those of skill in the art.

Importantly, these pins 14 and channels 16 are modular—that, is PCB joints 10 formed via these implementations allow the beams 4 to be easily removed for architectural reconfiguration of the structure or replaced individually, as would be understood by one of skill in the art.

Figure 2:
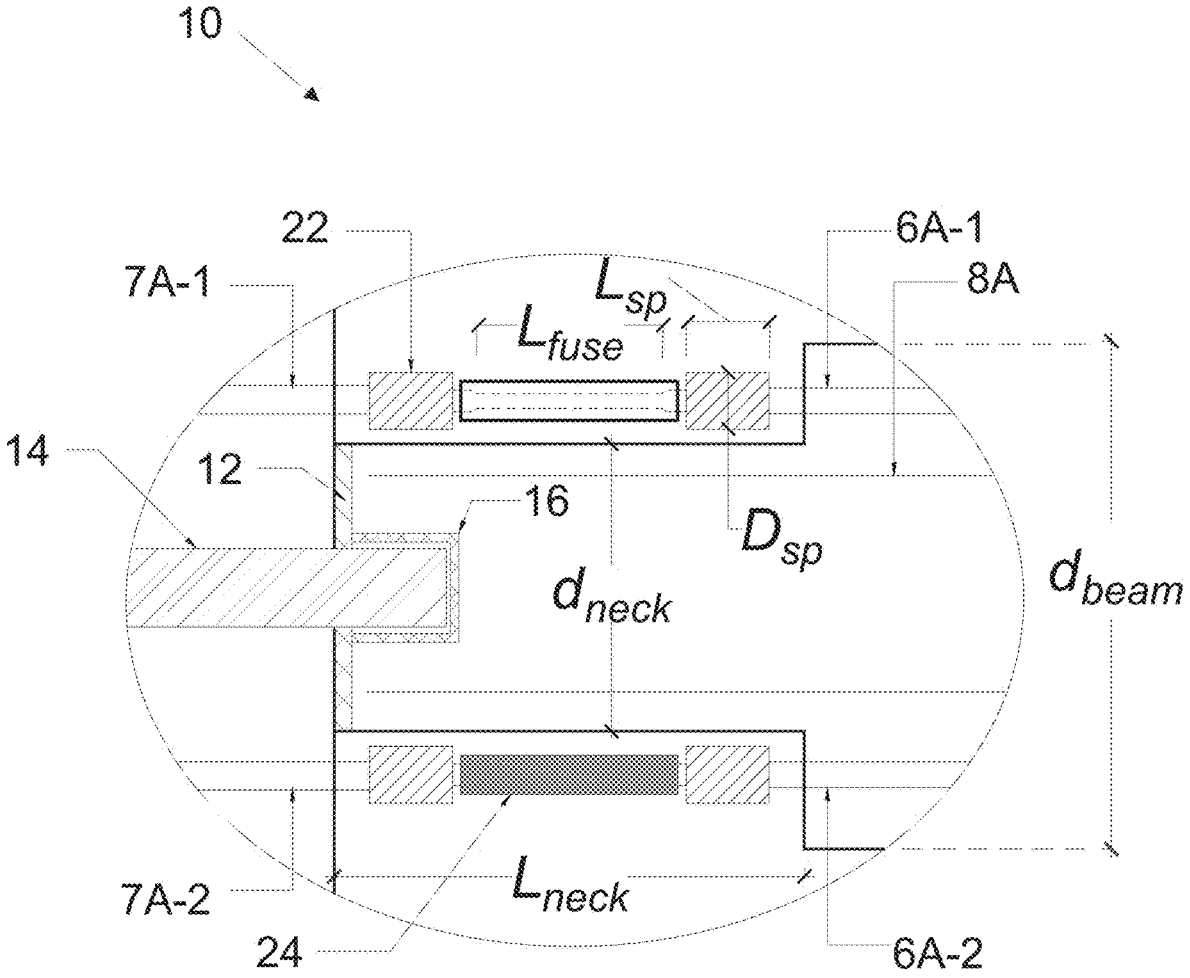
FIG. 2 is a close-up cross-sectional detailed view of an exemplary embodiment of a repairable precast moment-resisting beam-column joint.
Figure 3A:
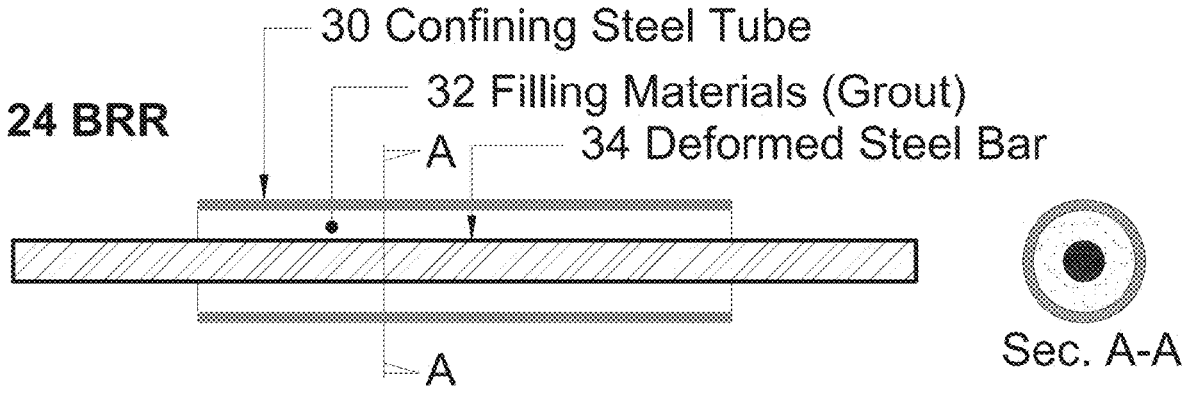
FIG. 3A is a cross-sectional of a detachable buckling restrained reinforcement, according to one embodiment.
Figure 3B:
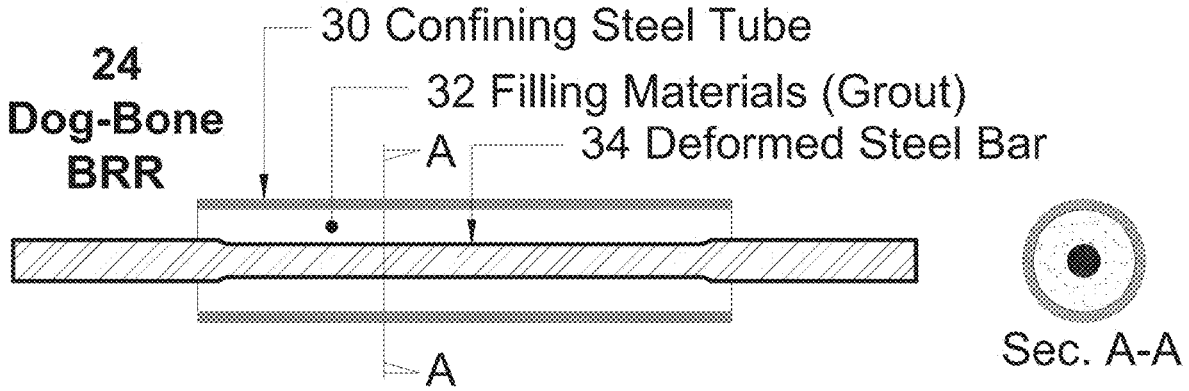
FIG. 3B is a cross-sectional of a detachable buckling restrained reinforcement, according to another embodiment.

As shown in FIG. 2 as well as in FIG. 3A and FIG. 3B, the neck 8 of the precast beam is reduced, or otherwise tapered, with a length of $L_{neck}$.

In various implementations, the beam longitudinal reinforcement bars 6A-1, 6A-2 extend into the neck region, where they are joined to column bars 7A-1, 7A-2 disposed within the column 2 above 7A-1 and below 7A-2 the pin 14 and/or channel 16 or socket 17. In these implementations the beam longitudinal reinforcing bars 6A-1, 6A-2 are coupled with the column bars 7A-1, 7A-2 through mechanical bar splices or couplers 22 and buckling restrained reinforcement (BRR) 24 disposed between the couplers 22 to provide flexural capacity for the joint 10. Further implementations comprise bars beyond the couplers 22. These implementations allow for quick and easy replacement of exposed bar after a severe event such as an earthquake, hurricane, explosion or the like.

The assembled top and bottom longitudinal bars, as shown in FIG. 2, include the beam longitudinal reinforcement bars 6A-1, 6A-2, column bars 7A-1, 7A-2, couplers 22 and BRR 24 at the neck region of the precast beams 2, should at least match the OP reinforcement to provide sufficient flexural strength. In these implementations, the box 14 and channel 16 or socket 17 are constructed and arranged to provide sufficient strength to remain linear elastic. Only yielding and damage of BRR is allowed in this implementation to minimize the building overall damage and to quickly repair buildings by replacing damaged BRR.

FIG. 2 depicts an additional detailing of the shear-pin 14/channel 16 connection, according to certain implementations. In implementations like that of FIG. 2, for optimal structural performance according to these implementations, the neck 8 length ($L_{neck}$) shall not be less than the BRR fuse length ($L_{fuse}$) plus four times the length of the coupler ($L_{sp}$). The neck depth ($d_{neck}$) shall be at least approximately the depth of the original beam ($d_{beam}$) less three times the coupler 22 diameter ($D_{sp}$). It is understood that many other configurations are possible. One may use larger beam sections to accommodate all components of 10.

In various implementations, the BRR fuse areas ($0.25\pi d_{fuse}$, where $d_{fuse}$ is the diameter of the bar 34 inside BRR 22, as shown in FIG. 3A and FIG. 3B) shall not be less than the top and bottom longitudinal reinforcement areas of a corresponding conventional cast-in-place beams at the same location. In addition, it is understood that the reinforcement adjacent to the BRR 24 reinforcement assembly should have an area larger than the BRR fuse reinforcement areas to ensure the yielding within BRR fuse areas.

As shown in the implementations of FIG. 3A and FIG. 3B, in certain implementations each BRR 24 has a confining steel tube 30 filled with a cementitious material 32 such as grout 32, both of which are encasing a deformed steel bar 34. As would be understood, many other implementations are possible.

In certain implementations, the BRR fuse 24 length, which is defined as the length of the yielding portion of the BRR, shall not be less than approximately 0.25 times the original (unreduced) depth of the precast beam ($0.25d_{beam}$) and does not exceed approximately 0.75 times the depth of the precast beam ($0.75d_{beam}$). That is, a BRR fuse with a length of approximately 0.25 times the depth of the precast beam ($0.25d_{beam}$) is preferential, as it is understood that such a BRR fuse length can provide sufficient displacement capacity exceeding that in corresponding cast-in-place buildings.

Accordingly, in use according to exemplary implementations, onsite construction begins with erecting the precast columns 2, which can be three- or four-stories or more tall depending on transportation and lifting limitations, wherein the embedded boxes 14 are disposed at each floor level.

Subsequently, the precast beams 4 with embedded steel channels 16—or a channel 16 made of two angles—are laterally placed between the columns 2, for example using the implementation presented in FIG. 2B. Alternatively, the precast beams 4 with movable boxes 14 can be secured in place then the boxes 14 are moved into the socket 17 using the handles 19 as shown in FIG. 2C.

Next, the beam 4 longitudinal bars 6A and the column longitudinal reinforcement 7A are connected to BRR 24 incorporating couplers 22. BRR 24 can be assembled/disassembled through attachable/detachable mechanical bar splices 22. To align the beam 4 and column 2 reinforcement with BRR 24, the beam depth should be reduced at either end 8, as would be appreciated by those of skill in the art.

Additionally, in certain implementations, precast slabs, such as hollow core slabs, are installed to complete a floor in the structure. It is expected that the detailing imposes tighter construction tolerance compared to cast-in-place methods. Nevertheless, the tolerance would be comparable to that in current practice for steel structures. Further implementations are of course possible and would be appreciated by those of skill in the art.

Ranges can be expressed herein as from "about" or "approximately" one particular value, and/or to "about" or "approximately" another particular value. When such a range is expressed, a further aspect includes from the one particular value and/or to the other particular value. Similarly, when values are expressed as approximations, by use of the antecedents "about" or "approximately," it will be understood that the particular value forms a further aspect. It will be further understood that the endpoints of each of the ranges are significant both in relation to the other endpoint, and independently of the other endpoint. It is also understood that there are a number of values disclosed herein, and that each value is also herein disclosed as "approximately" that particular value in addition to the value itself. For example, if the value "10" is disclosed, then "approximately 10" is also disclosed. It is also understood that each unit between two particular units are also disclosed. For example, if 10 and 15 are disclosed, then 11, 12, 13, and 14 are also disclosed.

EXPERIMENTAL EXAMPLES

The following examples are put forth so as to provide those of ordinary skill in the art with a complete disclosure and description of how the articles, devices and/or methods claimed herein are made and evaluated, and are intended to be purely exemplary of the invention and are not intended to limit the scope of what the inventors regard as their invention. However, those of skill in the art should, in light of the present disclosure, appreciate that many changes can be made in the specific embodiments which are disclosed and still obtain a like or similar result without departing from the spirit and scope of the invention.

Figure 4:
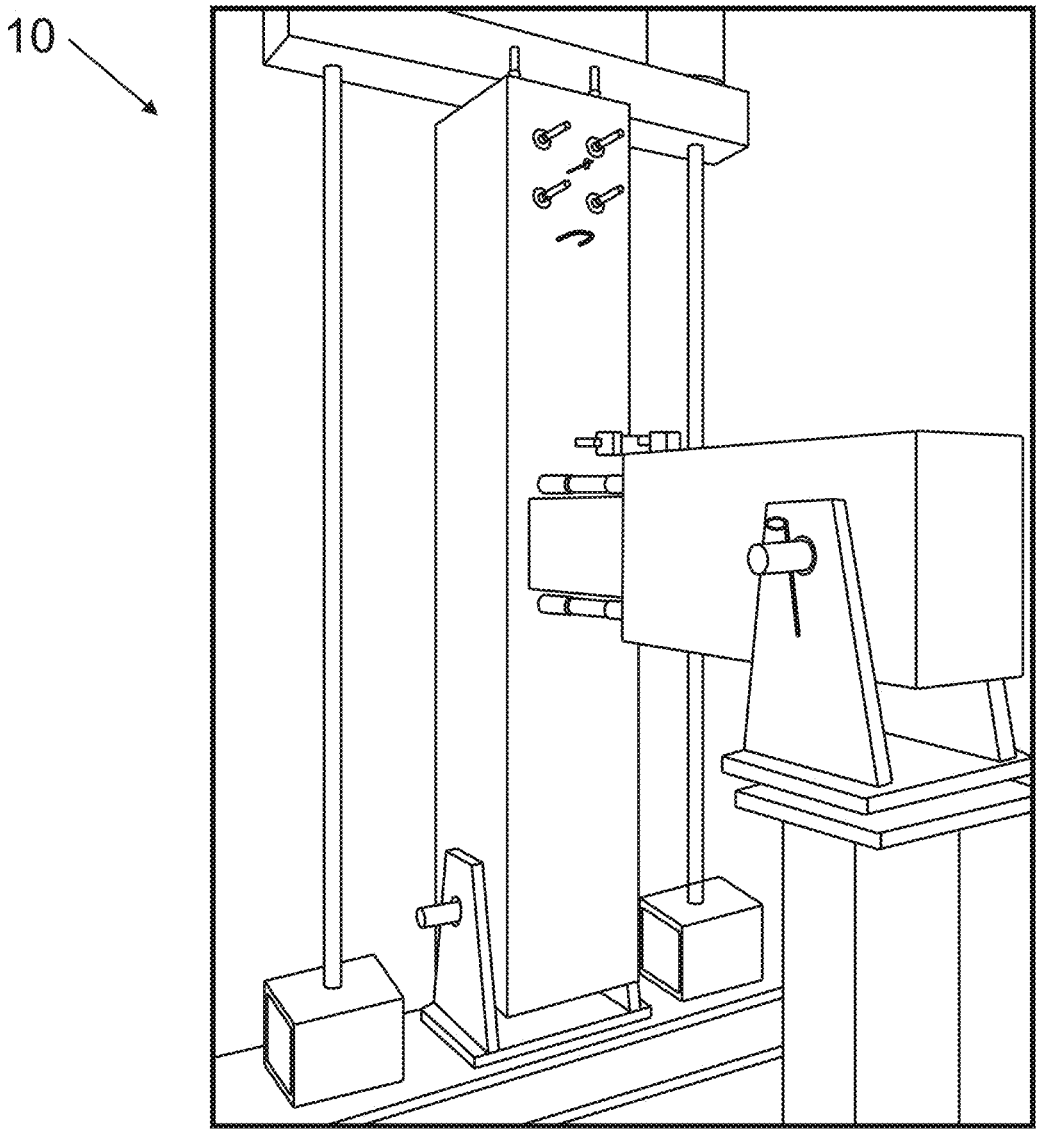
FIG. 4 depicts an exemplary embodiment of a precast beam-column specimen.

FIG. 4 shows an example precast beam-column (PBC) joint 10 erected for testing. The PCB joint 10 of the implementation of FIG. 4 is made with the same geometry and reinforcement as those found in a beam-column joint specimen constructed using conventional cast-in-place (CIP) method, which was used as the benchmark model. In this implementation, the shear pin or box was a steel pipe embedded in the precast beam to be inserted into a steel channel/socket installed in the precast column, much like the implementation shown above at FIG. 1C.

To simulate the lateral displacements of the test beam-column specimen within a portal frame, the column was pinned at the base while the beam was supported by a roller at the end. The pinned support (the rocker) was fabricated using a heavy-duty steel shaft passing through vertically slotted steel chair and through steel pipe installed at the column base. The roller support was constructed using the same configuration for the rocker but with the steel chair had a long horizontal slotted-hole to allow the beam to displace in its axial direction or the lateral direction of the frame. The vertical gap between the steel shaft and the chair was closed using a hand-tight bolt to prevent any uplift in the beam. An axial load of 68 kips (302.5 kN) was applied to the top of the column using two post tensioning bars and two 100 kips (445 kN) hollow-core jacks. A 22-kip (98-kN) actuator with a ±5-in. (127-mm) stroke was used at the column tip to apply lateral displacements using a cyclic loading protocol. Furthermore, two 50-kip (222-kN) compressive load cells were installed at the ends of the beam to measure the beam reactions, each with be activated during push or pull.

Eighteen strain gauges were utilized in the precast specimens to measure the strains at different locations. Four strain gauges were installed on the top and the bottom longitudinal reinforcing steel bars of each precast beam (two per bar), four strain gauges were placed on one of the top and the bottom BRR (two per bar), four were installed on the longitudinal bars of the precast column, and six were installed on the transverse reinforcement of beam or column.

To measure the rotations and curvatures of the beam in the plastic hinge region, six linear variable displacement transformers (LVDT) were placed at the top and bottom of the beam. Four string potentiometers (string POT) were used to measure lateral displacements of the specimen.

A displacement-based loading protocol was utilized for testing of all beam column specimens. Each target displacement was repeated twice per displacement amplitude. Two loading rates was used: a slow displacement rate of 0.03 in./sec (0.76 mm/sec) up to two times the expected yield displacement to capture the yield point, and a faster rate of 0.15 in./sec (3.8 mm/sec) at higher displacements.

Figure 5:
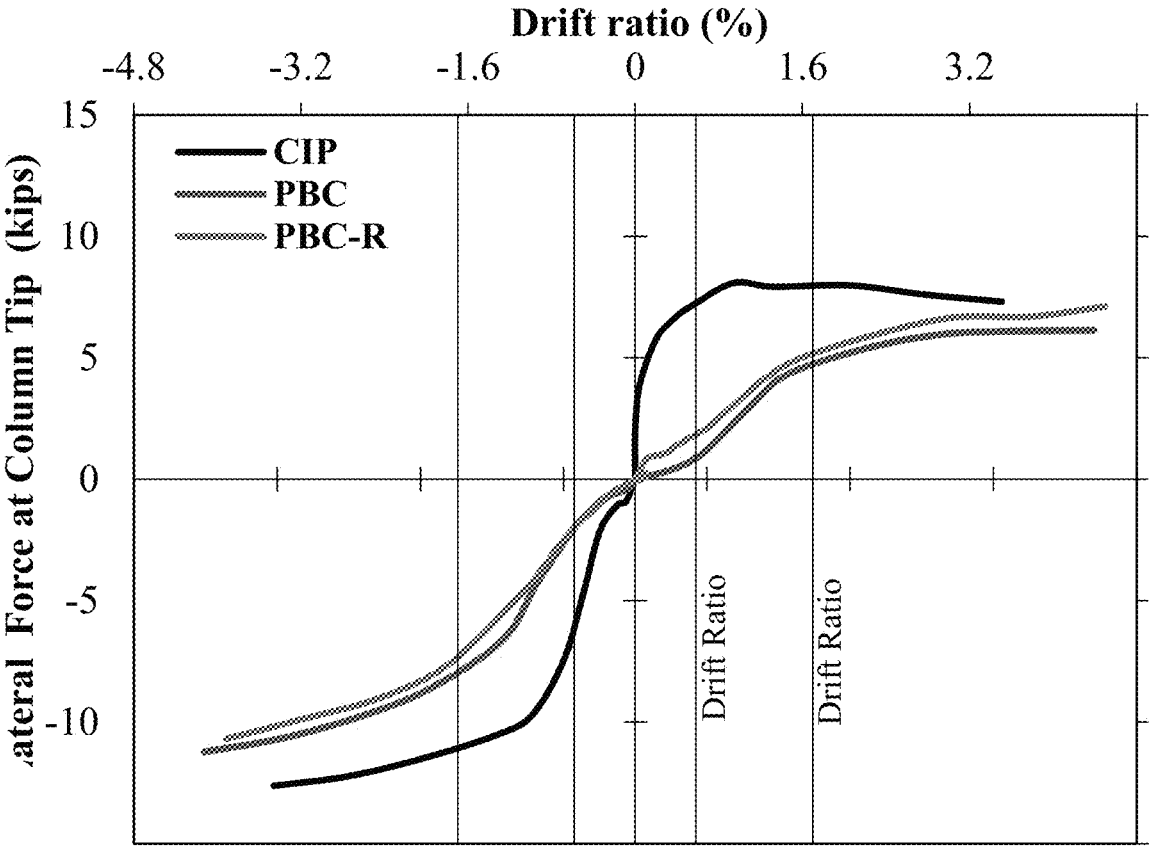
FIG. 5 shows a graph of force-displacement relationships for beam-column specimens, according to exemplary embodiments.

FIG. 5 depicts the drift ratio and column tip displacement (in inches) compared with the lateral force at the column tip (kips and kN) of an initial PBC and a repaired PBC (PBC-R) after testing and performing the repair, which was done by simply replacing the damaged buckling restrained reinforcement 24 (BRR), with new BRR 24. Drift ratio is defined as the ratio of the column tip displacement to the column height. The repaired PBC 10 (PBC-R) was retested with the same loading protocol as that for CIP and PBC 10.

Figure 6:
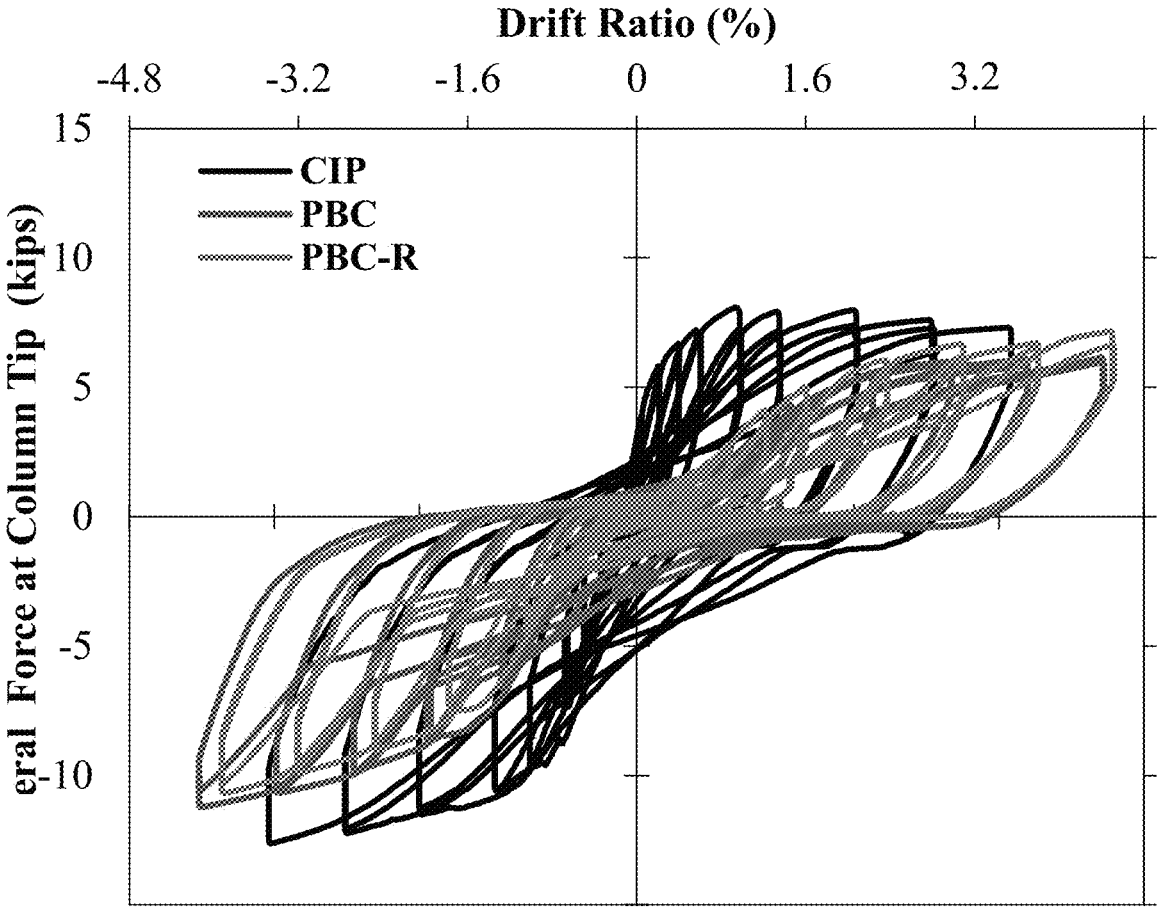
FIG. 6 shows a graph of cyclic force-displacement relationships for beam-column specimens, according to exemplary embodiments.

FIG. 6 shows the cyclic measured force-displacement relationships for CIP, PBC, and PBC-R. It can be seen that the PBCs have higher displacement capacities than that for the CIP. Furthermore, the performance of the precast specimens was essentially the same before and after the repair (which consisted of replacing the buckling restrained reinforcement) indicating that the PBC is a viable precast option with quick and low-cost repair approach.

Figure 7A:
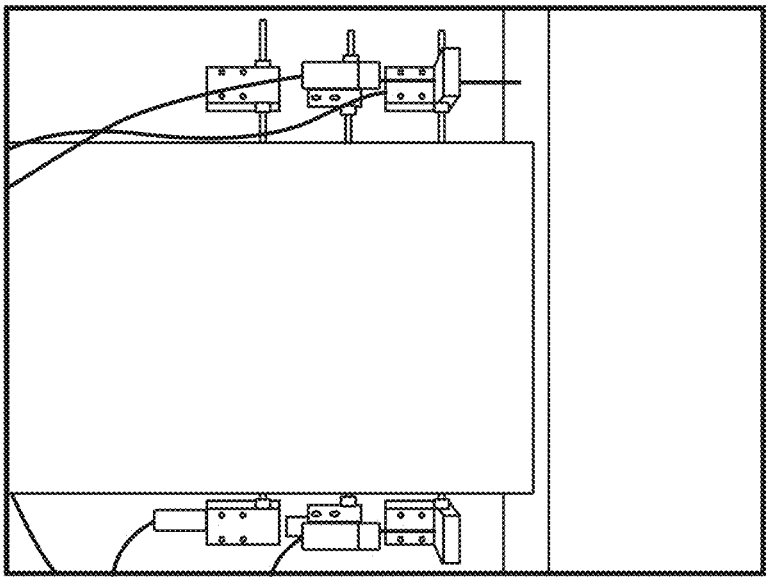
FIG. 7A depicts an exemplary embodiment of damage to a OP specimen at 2% drift ratio.
Figure 7B:
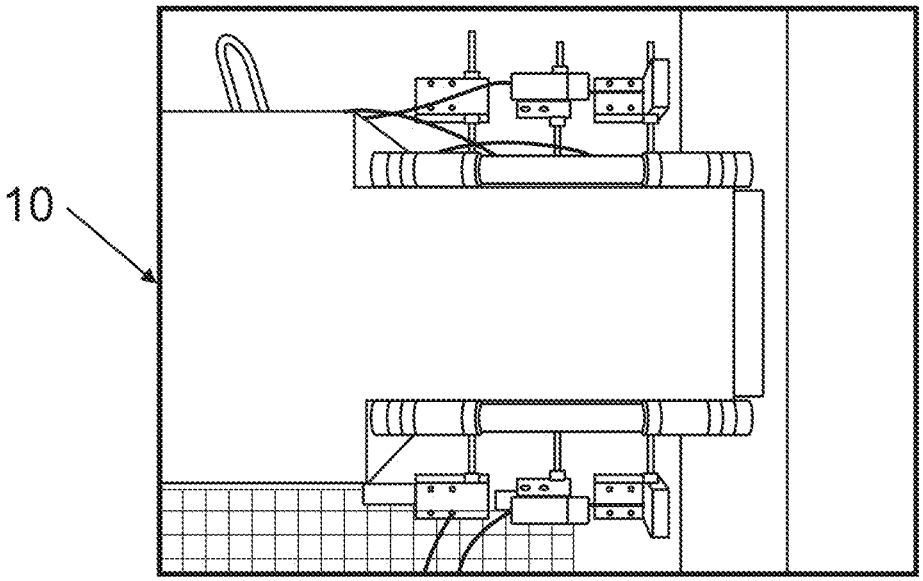
FIG. 7B depicts an exemplary embodiment of damage to a precast specimen at 2% drift ratio.

FIG. 7A and FIG. 7B depict exemplary photographs of the damage of the control specimen CIP and a PBC at a 2% drift ratio, which is the maximum allowable displacement demand for a special moment-resisting RC frame. The damage of the precast specimen was observably significantly less than that for CIP, indicating superior structural performance.

Figure 8A:
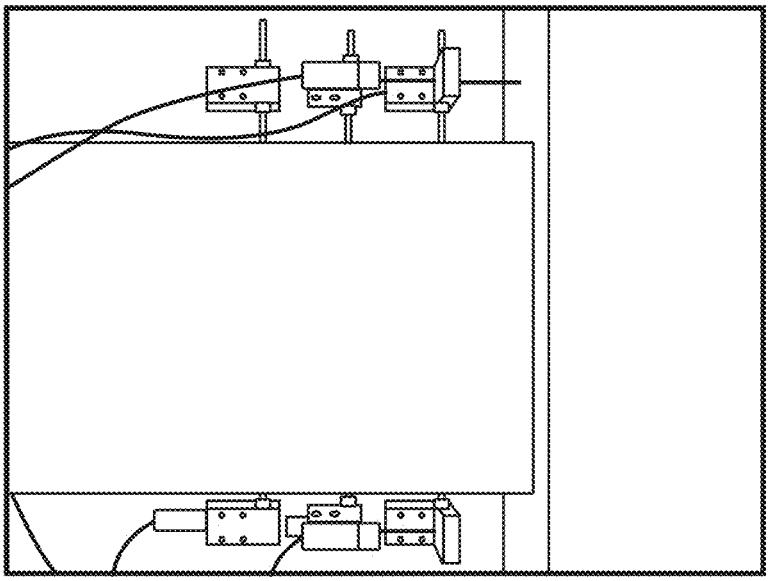
FIG. 8A depicts an exemplary embodiment of damage to a CIP specimen at 3.65% drift ratio.
Figure 8B:
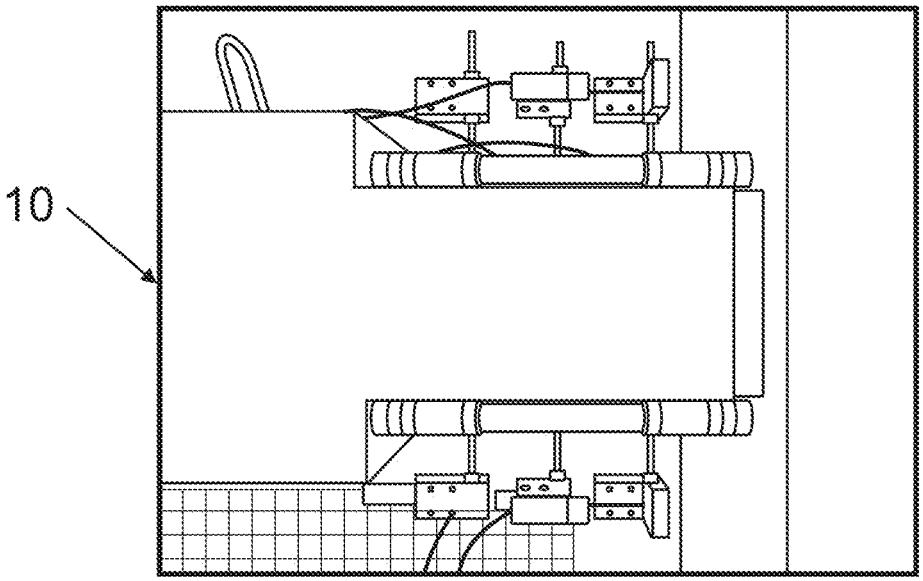
FIG. 8B depicts an exemplary embodiment of damage to a precast specimen at 3.65% drift ratio.

As shown in FIG. 8A, at a drift ratio of 3.65%, CIP failed since the longitudinal bars of the CIP beam fractured at the column-to-beam interface. However, as shown in FIG. 8B, the damage of PBC at this displacement was limited to some cosmetic cracking, thereby indicating superior structural performance for buildings that are constructed with the herein disclosed PBC 10. It is worth noting that the effect of the apparent cracks was structurally insignificant since the force-displacement relationship of the repaired PBC was the same as that for the original PBC, as was shown in FIG. 6.

Figure 9:
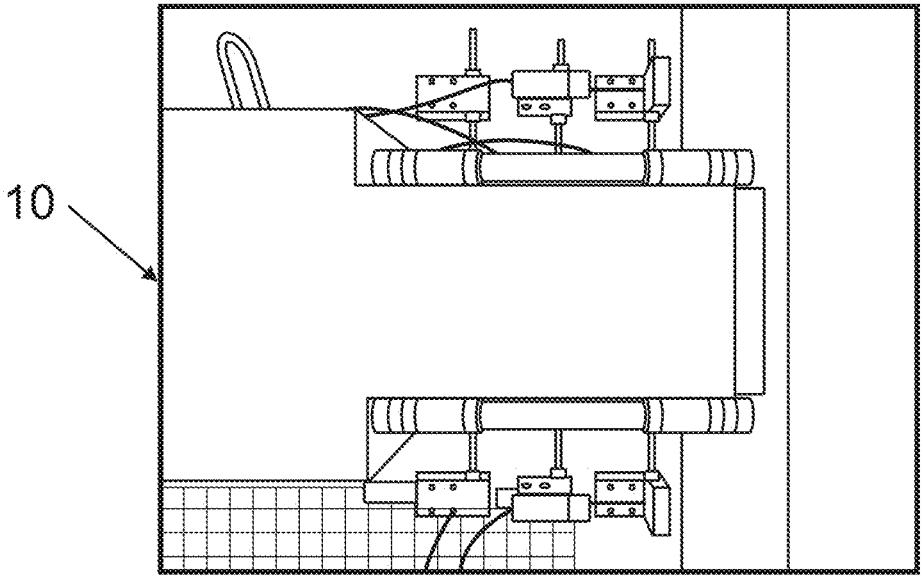
FIG. 9 depicts the damage to the precast specimen of FIG. 8B at 8% drift ratio.

The PBC of FIG. 8B was pushed to 8% drift ratio where its longitudinal bars fractured. As shown in FIG. 9, the damage was the same as that observed in FIG. 8B. Therefore, PBCs according to the disclosed implementations have significantly higher displacement capacities and lower damaged compared to most-ductile RC buildings practiced by current codes.

Further testing information and detail can be found in Boudaqa, Abdullah, "Repairable Precast Buildings and Bridges" (2018). *Electronic Theses and Dissertations.* 2467 (https://openprairie.sdstate.edu/etd/2467) which is hereby incorporated by reference in its entirety.

As will be appreciated by those of skill in the art, various aspects of these joints provide substantial advantages over the prior art.

One aspect is to reduce the impact of natural hazards by improving the resiliency of structures and infrastructures. Another aspect is to design and construct repairable precast MR RC buildings for high seismic regions. Another aspect is that an RC building can be constructed using detachable modular structural components to be replaced after a strong event or at the end of its service life. According to certain implementations, a building or other structure is therefore formed which is a system with replaceable modular structural components, rather than being a single unit.

In various aspects, the disclosed systems, methods and devices simultaneously accelerate construction and provide disassembly features for MR RC frames. The rationale underlying these implementations is that an MR RC building can be constructed as quickly as a steel building, total building replacement after an earthquake is avoided since damage is controlled and limited to the replaceable components, and building downtime and repair costs are minimal since the repair can be done in a few hours using simple tools such as pipe wrenches.

According to certain embodiments, the disclosed implementations offer unique advantages over current practice for reinforced concrete moment-resisting buildings. In certain aspects, the RC MRBs can be constructed as fast as steel MRBs. In additional aspects, the structural components of RC MRBs can be repaired in a few hours after a severe event such as earthquake and hurricane with minimal cost and unskilled labor. It is understood that the latter advantage is unique for any steel or concrete MRB. Even though current practices are sometimes able to prevent the collapse of MRBs, structural damage after a strong event may require demolition of the building and replacing with a new one, which imposes substantial material, labor, and downtime costs.

Various implementations achieve several various aspects. One aspect of the present system is to accelerate construction for MR RC buildings. One of the advantages of steel structures to RC is the speed of construction. Fully prefabricated RC members to be assembled onsite, thereby significantly reducing the construction time and will make RC buildings competitive to steel ones.

Another aspect is to eliminate MR RC building total replacement. Avoiding total building replacement will save millions of dollars. The repair technique through replacement of damaged components is simple and fast, which reduces the building downtime after severe earthquakes.

The system for MR RC buildings provides several improvements over the prior art because, by incorporating only conventional concrete and steel, RC buildings can be constructed relatively fast, are expected to exhibit better seismic performance, and will need minimal repair after strong earthquakes. The repair is done by replacing the damaged components.

Although the disclosure has been described with reference to certain embodiments, persons skilled in the art will recognize that changes may be made in form and detail without departing from the spirit and scope of the disclosed apparatus, systems and methods.

What is claimed is:

1. A repairable and replaceable moment-resisting precast beam-column joint comprising:

a. at least one precast beam having top and bottom sides and comprising:
   i. at least one neck;
   ii. at least one beam top longitudinal reinforcing bar disposed therein at the top side and having a beam top exposed portion; and
   iii. at least one beam bottom longitudinal reinforcing bar disposed therein at the bottom side and having a beam bottom exposed portion;

b. at least one precast column having top and bottom ends and comprising:
   i. at least one column top longitudinal reinforcing bar embedded in the column having a column top exposed portion constructed and arranged to couple to the beam top exposed portion; and
   ii. at least one column bottom longitudinal reinforcing bar embedded in the column having a column bottom exposed portion constructed and arranged to couple to the at least one beam bottom exposed portion;

c. at least one modular pin;

d. at least one modular channel;

e. a plurality of replaceable buckling restrained reinforcements; and f. a plurality of detachable couplers, wherein:

i. the at least one modular pin is configured to couple to the at least one channel so as to join the at least one beam to the at least one column, ii. the at least one column top longitudinal bar is disposed axially and to the top end above the pin, iii. the at least one column bottom longitudinal bar is disposed axially and to the bottom end below the pin, and iv. the exposed portions of the at least one beam top and at least one beam bottom longitudinal reinforcing bar and at least one column top and at least one column bottom bar are constructed and arranged to be correspondingly joined via the plurality of replaceable buckling restrained reinforcements and couplers.

2. The repairable and replaceable moment-resisting precast beam-column joint of claim 1, wherein at least one opening is defined in the at least one beam and the at least one pin is inserted into the at least one column.

3. The repairable and replaceable moment-resisting precast beam-column joint of claim 1, wherein at least one opening is defined in the at least one column to support the at least one modular beam in which the at least one pin is embedded.

4. The repairable and replaceable moment-resisting precast beam-column joint of claim 1, further comprising at least one neck longitudinal reinforcement.

5. The repairable and replaceable moment-resisting precast beam-column joint of claim 1, further comprising at least one steel plate at the end of the precast beam and/or the face of the precast column.

6. The repairable and replaceable moment-resisting precast beam-column joint of claim 1, wherein the at least one neck has a length ($L_{neck}$) and each of the plurality of replaceable buckling restrained reinforcements have a BRR fuse length ($L_{fuse}$), and $L_{neck}$ is not less than $L_{fuse}$ plus four times the length of the couplers ($L_{sp}$).

7. The repairable and replaceable moment-resisting precast beam-column joint of claim 6, wherein the neck depth ($d_{neck}$) is not be less than the depth of the beam ($d_{beam}$) less three times the coupler diameter ($D_{sp}$).

8. The repairable and replaceable moment-resisting precast beam-column joint of claim 6, wherein the beam has a body having a depth ($d_{beam}$) and $L_{fuse}$ is not less than about 0.25 $d_{beam}$.

9. The repairable and replaceable moment-resisting precast beam-column joint of claim 8, wherein $L_{fuse}$ does not exceed about 0.75 $d_{beam}$.

10. A repairable and replaceable moment-resisting precast beam-column joint comprising:

a. a precast beam having top and bottom sides and comprising:
   i. a body comprising:
      A. at least one beam top longitudinal reinforcing bar disposed therein at the top side and having a beam top exposed portion; and
      B. at least one bean bottom longitudinal reinforcing bar disposed therein at the bottom side and having a beam bottom exposed portion;
   ii. an elongate opening disposed therethrough;
   iii. first and second necks disposed at either end of the body; and
   iv. first and second modular channels disposed in the elongate opening within the first and second necks, respectively;

b. a precast column having top and bottom ends and comprising:
   i. at least one column top longitudinal reinforcing bar embedded in the column having a column top exposed portion constructed and arranged to couple to the bean top exposed portion;
   ii. at least one column bottom longitudinal reinforcing bar embedded in the column having a column bottom exposed portion constructed and arranged to couple to the at least one beam bottom exposed portion; and
   iii. a modular pin;

c. a plurality of replaceable buckling restrained reinforcements; and d. a plurality of detachable couplers, wherein:

i. the modular pin is configured to couple to the modular channel, ii. the at least one column top longitudinal bar is disposed axially and to the top end above the pin, iii. the at least one column bottom longitudinal bar is disposed axially and to the bottom end below the pin, and iv. the exposed portions of the at least one beam top and at least one beam bottom longitudinal reinforcing bar and at least one column top and at least one column bottom bar are constructed and arranged to be correspondingly joined via the plurality of buckling restrained reinforcements and couplers.

11. The repairable and replaceable moment-resisting precast beam-column joint of claim 10, wherein the modular pin and first and second modular channels are constructed and arranged so as to be replaceable.

12. The repairable and replaceable moment-resisting precast beam-column joint of claim 10, wherein the plurality of buckling restrained reinforcements are dog bone buckling restrained reinforcements.

13. The repairable and replaceable moment-resisting precast beam-column joint of claim 10, wherein the plurality of buckling restrained reinforcements comprise:

a. a confining steel tube;

b. filling materials; and c. a steel bar.

14. The repairable and replaceable moment-resisting precast beam-column joint of claim 13, wherein the steel bar is a deformed steel bar.

15. The repairable replaceable moment-resisting precast beam-column joint of claim 10, wherein the at least one neck has a length ($L_{neck}$) and each of the plurality of replaceable buckling restrained reinforcements have a BRR fuse length ($L_{fuse}$), and $L_{neck}$ is not less than $L_{fuse}$ plus four times the length of the couplers ($L_{sp}$).

16. The repairable replaceable moment-resisting precast beam-column joint of claim 15, wherein the neck depth ($d_{neck}$) is not be less than the depth of the beam ($d_{beam}$) less three times the coupler diameter ($D_{sp}$).

17. The repairable replaceable moment-resisting precast beam-column joint of claim 15, wherein the beam has a body having a depth ($d_{beam}$) and $L_{fuse}$ is not less than about 0.25 $d_{beam}$.

18. The repairable replaceable moment-resisting precast beam-column joint of claim 17, wherein $L_{fuse}$ does not exceed about 0.75 $d_{beam}$.

* * * * *